US007387550B2

(12) United States Patent
Myer et al.

(10) Patent No.: US 7,387,550 B2
(45) Date of Patent: Jun. 17, 2008

(54) DUAL BEAM RECEPTACLE CONTACT

(75) Inventors: John M Myer, Millersville, PA (US); Hurley C Moll, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/186,436

(22) Filed: Jul. 21, 2005

(65) Prior Publication Data

US 2007/0021013 A1 Jan. 25, 2007

(51) Int. Cl.
*H01R 11/22* (2006.01)

(52) U.S. Cl. ..... 439/852

(58) Field of Classification Search ..... 439/839–863
See application file for complete search history.

(56) References Cited

U.S. PATENT DOCUMENTS 4,838,816 A * 6/1989 Matsusaka et al. ..... 439/861
5,112,254 A * 5/1992 Endo ..... 439/852
5,443,592 A * 8/1995 Ittah et al. ..... 439/851
5,791,945 A * 8/1998 Myer et al. ..... 439/852
6,305,993 B1 * 10/2001 Heimueller ..... 439/852
6,379,199 B1 * 4/2002 Chen ..... 439/852
6,520,811 B2 * 2/2003 Mitani et al. ..... 439/852
6,547,608 B2 * 4/2003 Sato et al. ..... 439/852

FOREIGN PATENT DOCUMENTS

EP 0 650 223 4/1995
EP 0 661 775 7/1995
EP 0 687 033 12/1995
EP 1 137 108 9/2001

OTHER PUBLICATIONS

European Patent Office Search Report, EP 06 11 7549, Nov. 3, 2006.

* cited by examiner

*Primary Examiner*—Briggitte R. Hammond

(57) ABSTRACT

A dual beam receptacle terminal is shown having a generally box shaped receptacle contact where first and second contact portions are reversely bent from an upper wall to overlap within an interior of the receptacle contact. The first and second contact portions also extend in a cantilevered fashion from the upper wall. A spherical dimple is provided on the upper of the two reversely bent contact portions in the location of the overlapped portion. Contact stop portions are provided on the side walls of the receptacle contact portion which engage the contact stop portions on the receptacle sidewalls. A coverwall is provided overlapping the upper wall which forms a clean seam with the sidewall from which the upper wall extends.

14 Claims, 11 Drawing Sheets

DUAL BEAM RECEPTACLE CONTACT

BACKGROUND OF THE INVENTION

The invention relates to an electrical contact for use with a mating pin or blade contact to join electrical wires or other electrical conductors together.

It is well known in the art of electrical connectors to provide a receptacle contact or terminal for the receipt of a pin or blade contact where the receptacle contact has contact beams which extend from a receptacle body and are profiled to electrically engage a pin or blade contact upon insertion thereof. This contact between the receptacle contacts and its corresponding pin or blade contact interconnects the two pin and receptacle contacts and results in an electrical connection between the two and their associated mating conductors.

Multiple different requirements are involved in such an electrical device, particularly when used in a multi-position connector, for example when used in an automotive connector.

First, it is a requirement to provide a normal force between the receptacle contact and its associated pin or blade contact in order to provide the electrical connection between the two. In an effort to increase this normal force between the contact and the associated pin or blade contact, it is known to provide such devices as backup springs and other devices to enhance the normal force between the contact and its associated pin or blade contact. However in the instance of a multi-position connector, this enhanced normal force resultantly corresponds with an increased mating force as well which can negatively affect the overall objective. Suffice it to say that it is a delicate balance between the normal force of the mated connection, versus the mating force between the associated pin and receptacle contacts.

Other requirements that are necessary for multi-position connectors, is that the contact must be capable of sealing. In some cases, a discreet wire seal is crimped to individual contacts around individual wires, and the contact and its associated seal are inserted into an aperture in a connector housing. In other cases a rear seal is provided having a multitude of apertures through which individual contacts are inserted where the contacts are larger than the hole through which they extend, as the holes are nominally provided to sealingly engage the discreet wire to which they are connected.

One electrical receptacle is shown in U.S. Pat. No. 5,791,945 (incorporated herein by reference) where dual beam contacts are provided in a reversely bent sense such that their free ends overlap, with one beam forming a primary contact and the other beam providing a backup or secondary contact. In other words when a pin is inserted into the receptacle, the pin engages the primary contact and the insertion of the pin causes the deflection of the primary contact to a position where it engages the secondary and backup contact at which point the two travel together under an increased normal force.

While this concept is sound for some contact scenarios, as the contacts are reduced, some modifications are required. First, the contact has an anti-overstress feature which is stamped and struck from the top wall of the receptacle which extends downwardly to form an engagement lug with the secondary contact backup portion. Thus the primary and secondary contacts cannot be deflected beyond the position where the secondary contact engages its corresponding lug. As mentioned above, while this concept is sound for some contact sizes, as the contact is reduced in its overall dimensions, having the overstress feature extend from the top wall can cause an issue with dimensional stack up, as the receptacle "box" and the various metal thicknesses add to the dimensional disparity.

Also, the first and second contact arms, when used in a smaller dimension contact, can cause a "spiking" effect when the first and second contacts first engage each other. Said differently, due to the geometries of the primary and secondary contacts, when the primary contact makes engagement with the secondary contact, it engages along a line contact at the front edge of the secondary contact, the two then travel together until the two contacts are substantially parallel and overlapping, and then move to a position where the two are along a line contact engaging the rear edge of the primary contact. The point where the two contacts are in a flat position can cause a spiking of mating force due to the increased force required to overcome this flattened position.

SUMMARY OF THE INVENTION

The subject invention provides an electrical terminal comprising a body portion comprising a lower wall, an upper wall, and side walls connecting the upper and lower walls. The upper and lower walls and the side walls forms a body interior portion. A first contact portion extends from one of the walls and is reversely bent into the body interior portion. A second contact portion extends from the one wall, and is reversely bent into the body interior portion. The first and second contacts extending in opposite and overlapping relation. At least one indentation extends into the body interior portion, and extends from a wall transverse to the one the wall, the indentation providing a stop position for the first contact portion.

The first and second contacts may extend from the upper wall. The indentation may extend inwardly from one of the side walls. The indentation may be sheared along a lower edge and formed inwardly to define a downwardly extending cup-shaped portion, with the sheared edge forming the stop position. The first contact portion, in the location of the indentation, may form a T-shaped portion.

In another aspect of the invention, an electrical terminal, comprises a body portion comprising a lower wall, an upper wall, and side walls connecting the upper and lower walls, the upper and lower walls and the side walls forming a body interior portion. A first contact portion extends from one of the walls and is reversely bent into the body interior portion. A second contact portion extends from the one wall, and is reversely bent into the body interior portion, the first and second contact portions extending in opposite and overlapping relation. The first and second contact portions extend from the one wall in a cantilevered fashion.

The cantilevered portions on the first and second contact portions may extend in the same plane as the one wall. The first and second contact portions may extend from the upper wall. The lower wall may include a lower contact portion formed inwardly in an axial position adjacent the first and second contact portions. The second contact portion may include a crowned portion, extending towards, and in the overlapping portion with, the first contact portion.

In yet another embodiment, an electrical terminal, comprises a body portion comprising a lower wall, an upper wall, and side walls connecting the upper and lower walls, the upper and lower walls and said side walls forming a body interior portion. A first contact portion extends from one of the walls and is reversely bent into the body interior portion. A second contact portion extends from the one wall, and is reversely bent into the body interior portion, the first and second contact portions extending in opposite and overlapping relation. The second contact portion includes a crowned portion, extending towards, and in the overlapping portion with, the first contact portion.

The crowned portion may be arcuate, and profiled such that the first and second contact portion pivot about the arcuate portion, as the first and second contact portions are deflected. The crowned portion may be defined as a spherical dimple. The first and second contact portions may extend from the upper wall. The lower wall may include a lower contact portion, formed inwardly in an axial position adjacent the first and second contact portions. The first and second contact portions may extend from the one wall in a cantilevered fashion, and the cantilevered portions on the first and second contact portions may extend in the same plane as the one wall.

In a final embodiment, an electrical terminal comprises a lower wall portion, and a first sidewall portion upstanding from the lower wall and having an upper edge. A second sidewall portion upstands from an opposite edge of the lower wall portion. A contact portion extends integrally from the upper edge and extends inwardly and between the lower wall and first and second sidewalls, leaving the remaining upper edge exposed. An outer wall, overlaps the contact portion, and includes a downwardly extending lip, with a downwardly extending edge coinciding with the upper edge.

The contact portion may comprise a strap portion extending from the upper edge. The contact portion may further comprise a first contact portion extending from the strap portion, and being reversely bent into an interior of the walls. The contact portion may further comprise a second contact portion extending from the strap portion and being reversely bent in an opposite sense as the first contact, with the first and second contacts extending in opposite and overlapping relation.

DETAILED DESCRIPTION OF THE INVENTION

Figure 1:
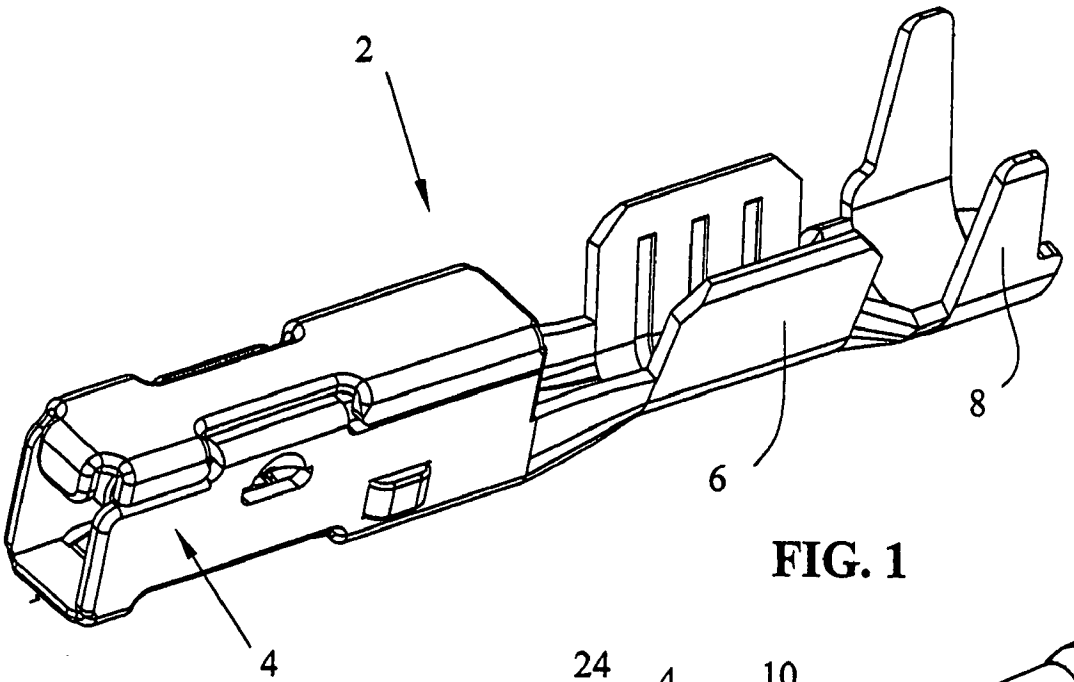
FIG. 1 is a front perspective view of the electrical receptacle terminal of the present invention.
Figure 2:
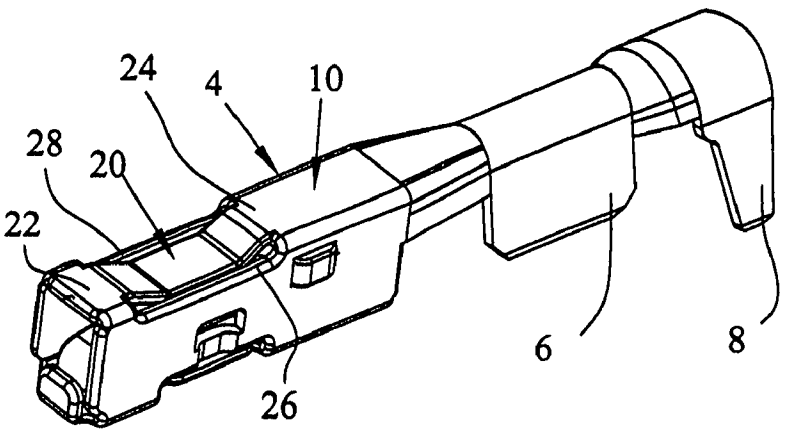
FIG. 2 is a lower perspective view of the terminal shown in FIG. 1.

With respect first to FIGS. 1 and 2, an electrical receptacle terminal is shown at 2 including the receptacle contact portion 4, a wire crimp section at 6 and a strain relief section at 8.

Figure 3:
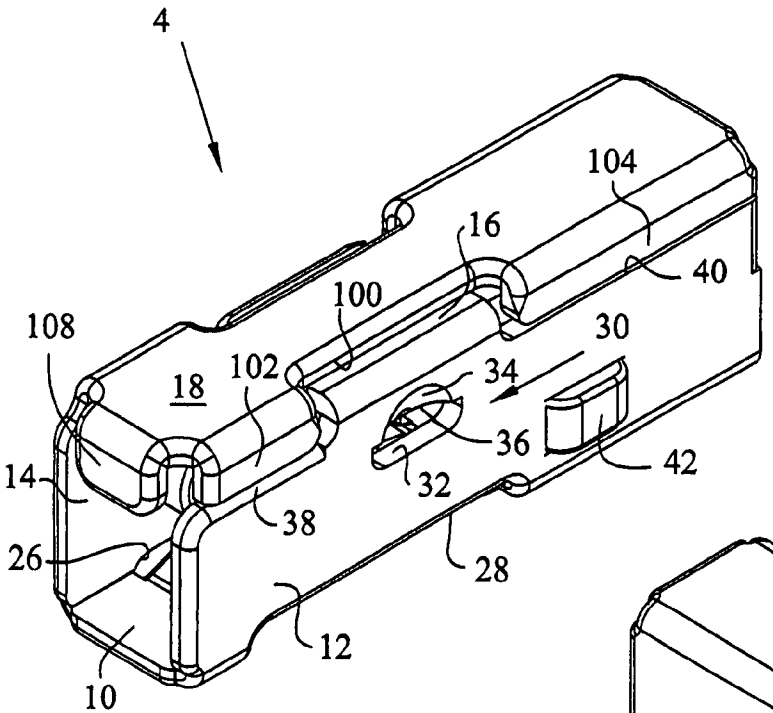
FIGS. 3-6 show various perspective views of the receptacle terminal portion of the terminal.

With respect now to FIGS. 3 through 6, the construction of the receptacle contact portion 4 will be described in greater detail. As shown in FIG. 3, the receptacle contact portion 4 includes a lower wall 10, sidewalls 12, 14, an upper wall 16 and a cover wall 18, which together form a body interior portion. With reference again to FIG. 2, lower wall 10 includes an inwardly directed contact portion at 20 defined as a beam extending between wall parts 22 and 24 and having separations at 26, 28. The contact portion 20 is thereafter inwardly directed and can act as a resilient contact extending between the wall parts 22, 24.

With reference again to FIG. 3, sidewall 12 is shown including a contact stop portion 30, which will be described herein which includes a lower cut-out portion at 32 and an inwardly directed spherically-shaped indentation at 34 defining a lower engagement edge at 36. Sidewall 12 further includes a forward recessed section at 38 and a rearward recessed section at 40. The upper wall 16 itself extends integrally from sidewall 12, and both the forward 38 and rearward 40 recessed sections are recessed from the upper wall 16, as will be discussed further herein. Finally, sidewall 12 can include an aligning lug such as 42 for aligning the terminal with an associated housing cavity (not shown).

Figure 4:
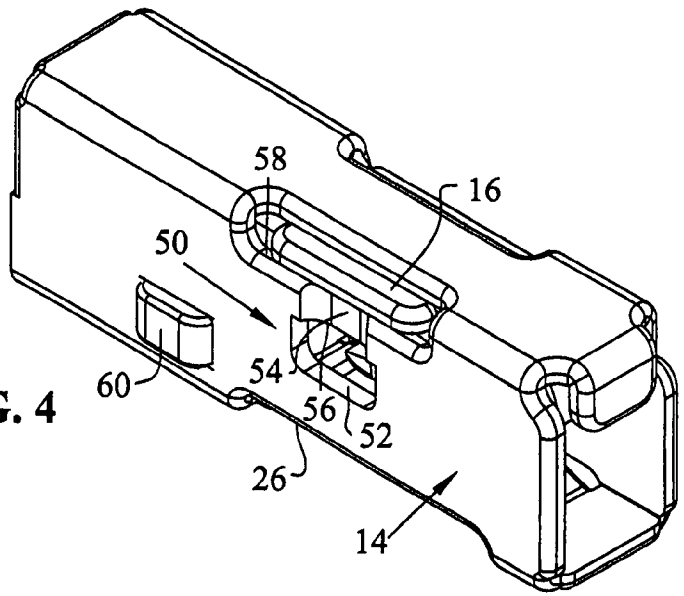
Figure 5:
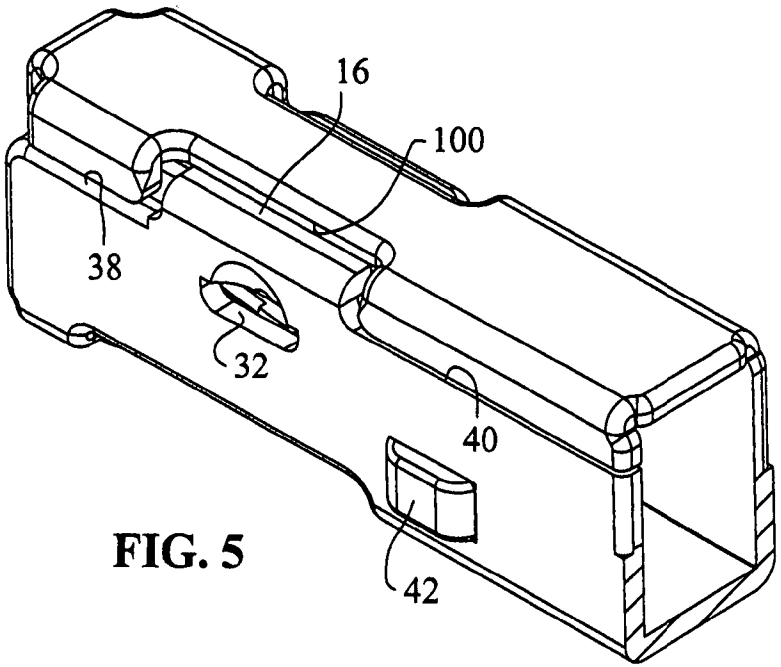

With reference now to FIG. 4, sidewall 14 includes a contact stop-portion 50 including a cut-out portion at 52 and a strap portion at 54 extending above the cut-out portion 52 and inwardly directed to define a lower engagement edge at 56. Sidewall 14 further includes a recessed section at 58, intermediate recessed sections 38, 40 of sidewall 12, as will be further discussed herein. Finally, sidewall 14 can also include an aligning lug such as 60 again for aligning the terminal with a housing cavity.

Figure 6:
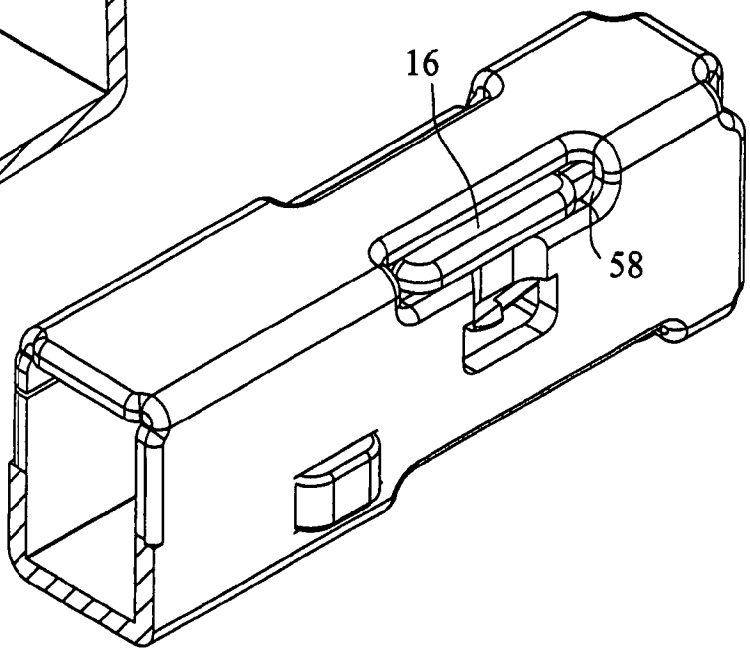
Figure 7:
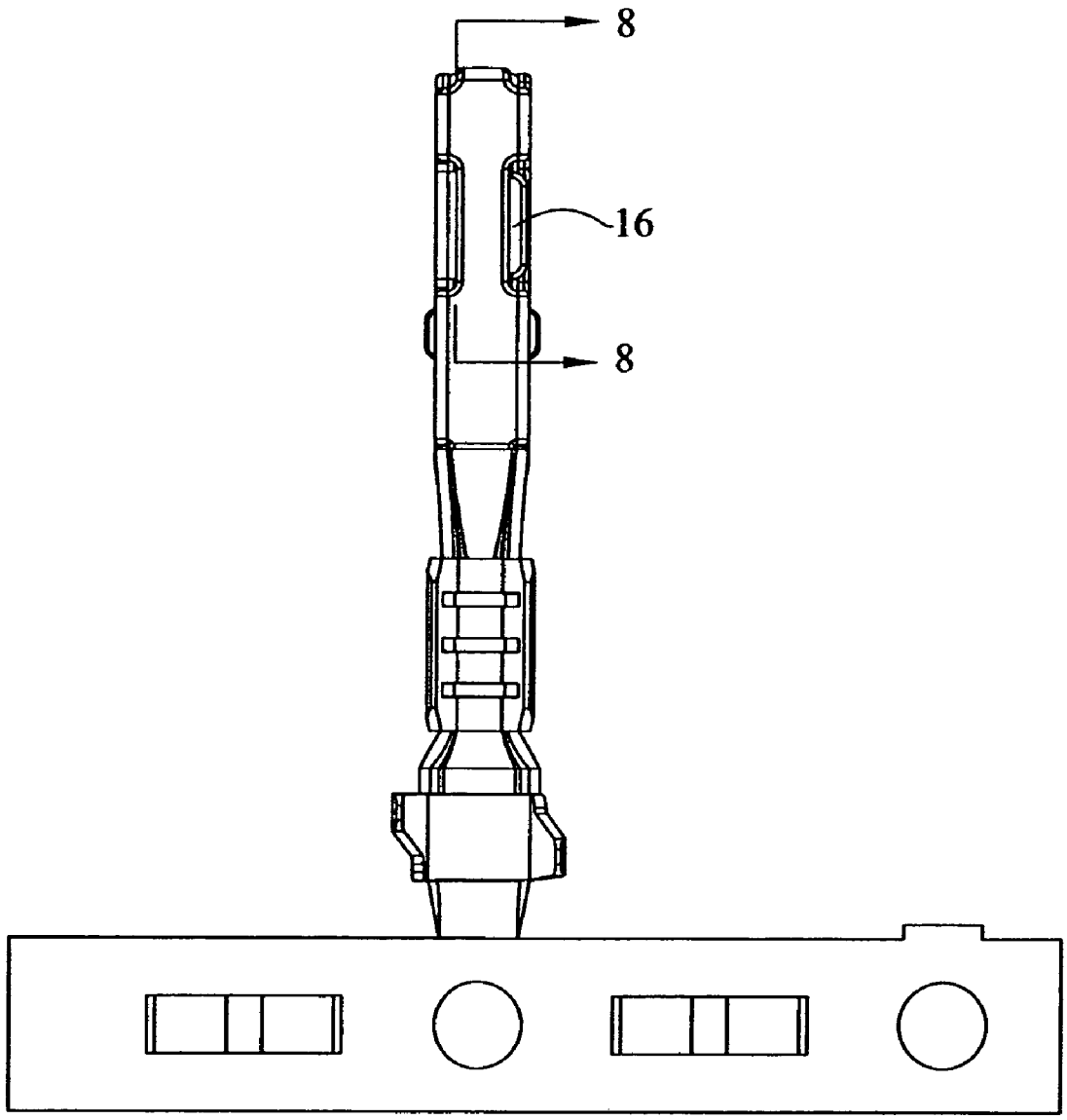
FIG. 7 top plan view of the terminal of FIG. 1, with the terminal connected to the carrier strip.
Figure 8:
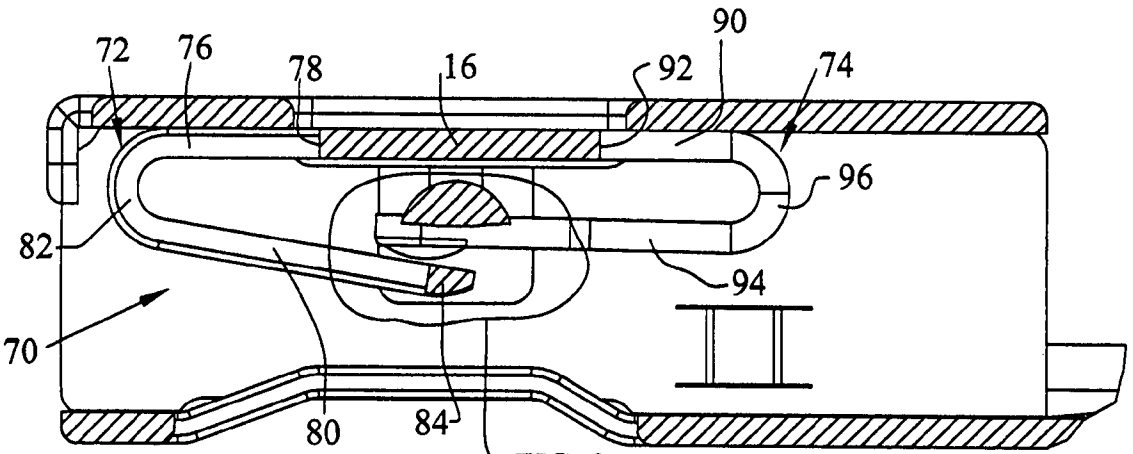
FIG. 8 is a cross-sectional view shown through lines 8-8 of FIG. 7.

With reference now to FIGS. 3 through 7, upper wall 16 is shown spanning between sidewalls 12 and 14 and integrally connected to sidewall 12. As shown in FIGS. 4, 6, and 7, upper wall 16 is shown received in recessed section 58 of sidewall 14. With reference now to FIG. 8, upper wall 16 is shown in section yet includes a contact assembly 70 extending integrally from upper wall 16 to include a first or primary contact portion 72 and a second or secondary contact portion 74.

With reference still to FIG. 8, first contact portion 72 includes a cantilever portion 76 extending integrally from front edge 78 of upper wall 16. First contact portion 72 further includes a reversely bent portion 80, reversely bent through radiused portion 82. Finally, first contact portion 72 includes extension portions 84 extending on both sides of reversely bent portion 80 to form a T-shaped portion as will be described further herein.

Figure 9:
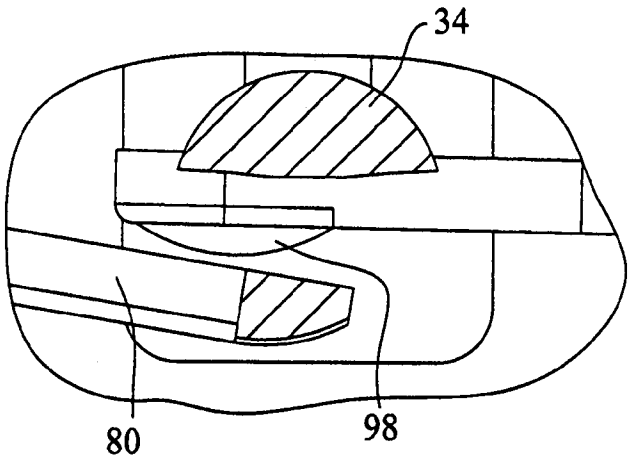
FIG. 9 is an enlarged view of the portion denoted in FIG. 9.

With reference still to FIG. 8, second contact portion 74, includes a cantilevered portion at 90 extending integrally from a rear-edge 92 of upper wall 16 and includes a reversely bent portion 94, reversely bent through radiused portion 96. As best shown in FIG. 9, the free-end of reversely bent portion at 94 is crowned, to define a spherically shaped dimple 98 (FIG. 9) positioned over reversely bent portion 80, in the overlapping region of reversely bent portions 80, 94.

With reference again to FIG. 3, cover wall 18 includes a recessed section at 100 with downwardly extending lip portions 102, 104 which flank the upper wall 16 and extend into the recessed sections 38 and 40, as described herein. Cover wall 18 further includes a downwardly extending flap 108 to assist in directing a pin on insertion thereof. With the product as described above, the manufacturing of the terminal will now be described with reference to FIG. 12.

Figure 10:
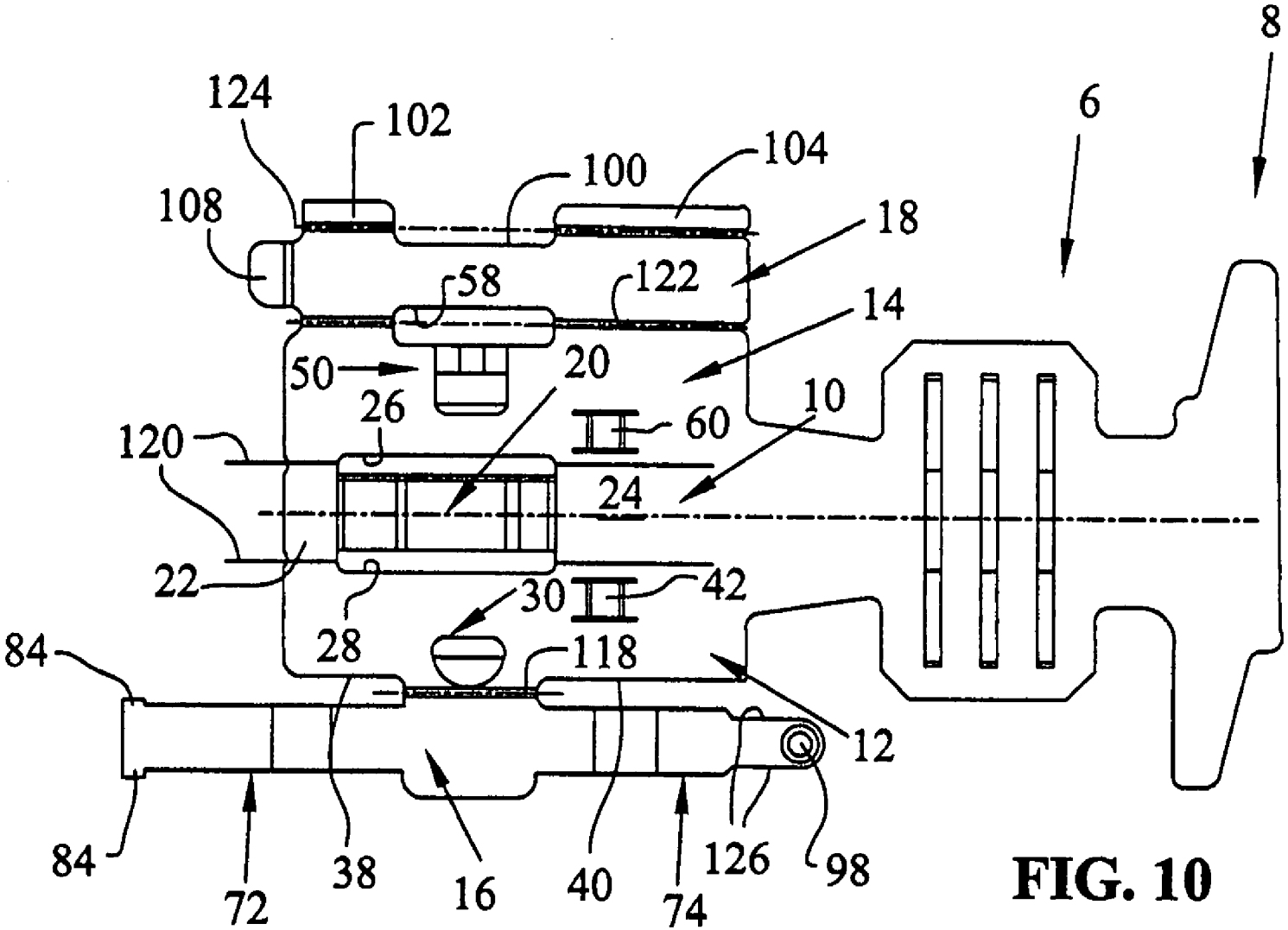
FIG. 10 shows the receptacle terminal of FIG. 1 in the flat blank condition.

As shown in FIG. 10, the terminal is shown in a flat blank condition, from the inside surface of the terminal. The blank is stamped to include the shape as shown, and then formed to define such features as the inwardly directed contact portion 20, the stop portions 30, 50, the aligning lugs 42, 60 and the dimple 98. The contact formation would include the reversely bending of contact portions 72 and 74, and then the folding of the terminal into the square receptacle form, by folding the contact portions along lines 118, 120, 122, and 124, and into the configuration of FIGS. 1 and 2.

Note that FIG. 10 also provides a good view of some features not seen in the previous views. First, FIG. 10 shows extension portions 84, which are wider than the associated reversely bent portion (FIG. 8) which form a T-shaped portion adjacent the end. Secondly, FIG. 10 shows second contact portion 74 including a necked-down section defined by side edges 126.

With respect to FIGS. 10 through 15, the operation of the receptacle terminal will now be described. It should be appreciated from the previous discussion, that contact assembly 70 together with inwardly directed contact 20, together provide opposed contacts for receipt of a pin or other male component.

Figure 13:
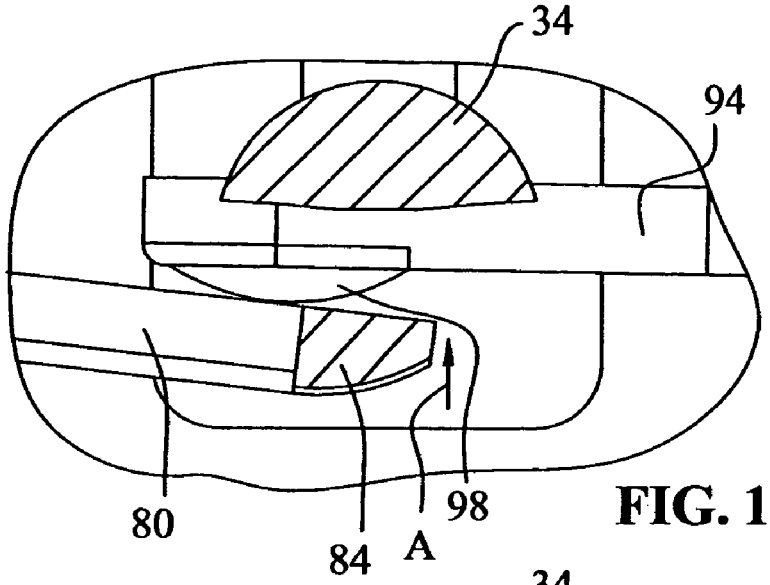
FIG. 13 is a view similar to that of FIG. 9 showing the first and second contact portions in initial contact.

With respect first to FIG. 13, as a pin is first inserted, reversely bent portion 80 begins to rotate in the counterclockwise sense as viewed in FIG. 13 (see arrow A) to the position where the reversely bent portion 80 contacts the spherical dimple 98. Up until this point, it should be appreciated that the first contact portion 72 and more particularly, the reversely bent portion 80 moves alone. Further insertion of the pin, as shown in FIG. 14, causes the two reversely bent portions 80, 94 to travel together, also causing the reversely bent portion 80 to pivot around the spherical dimple 98.

Figure 12:
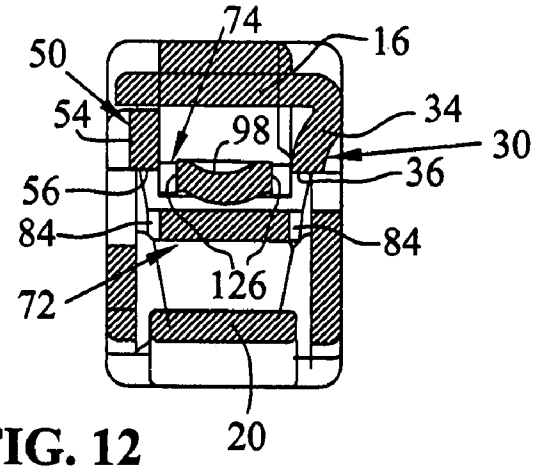
FIG. 12 shows a cross sectional view through lines 12-12 of FIG. 11.
Figure 11:
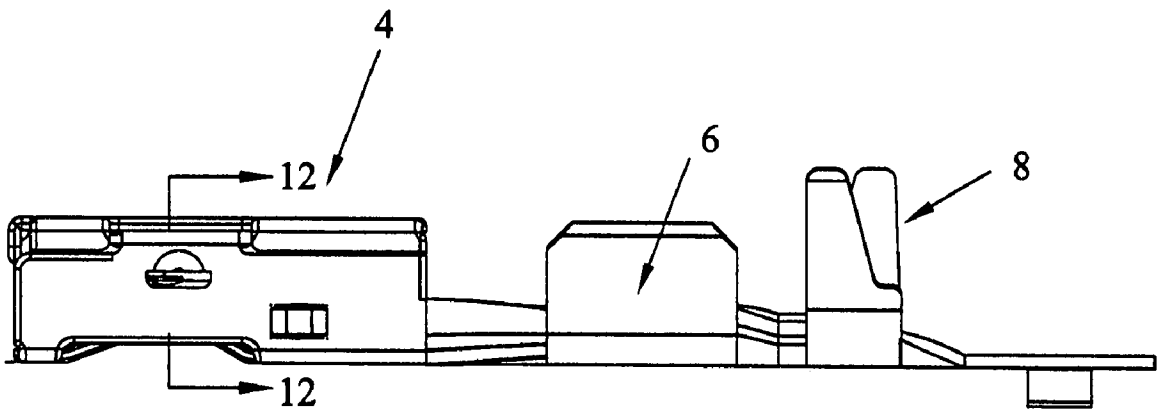
FIG. 11 shows a side view of the terminal of FIG. 7.

Furthermore, the reversely bent contact portion 94, passes through the contact stops 30, 50. This is due to the necked down surfaces 126 discussed with reference to FIG. 10. This is shown in cross section in FIG. 12, where the surfaces 126 are shown being received between the contact stops 30, 50. As shown in FIG. 12, the necked-down section defined by surfaces 126 allow second contact portion 74 to be positioned intermediate indentations 34 and 54.

Figure 15:
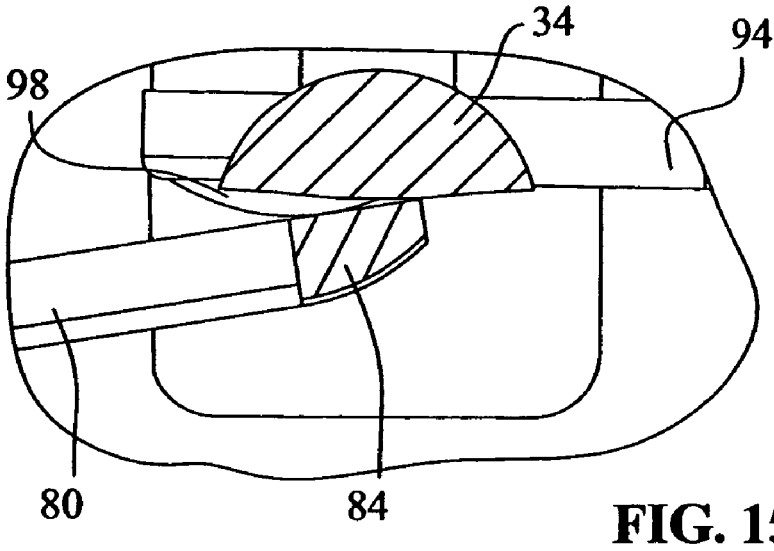
FIG. 15 shows the first and second contact portions moved to their extreme position.

Rather, extension portions 84 of reversely bent portion 80, are defined wider than engagement edges 36, 56, (again seen in FIG. 12) and therefore will contact the engagement edges 36, 56 upon upward biasing of first contact portion 72 to that point. FIG. 15 also shows the two reversely bent portions 80, 94 in their final position, where extensions 84 contact the engagement edges 36 of stop portion 30.

Figure 14:
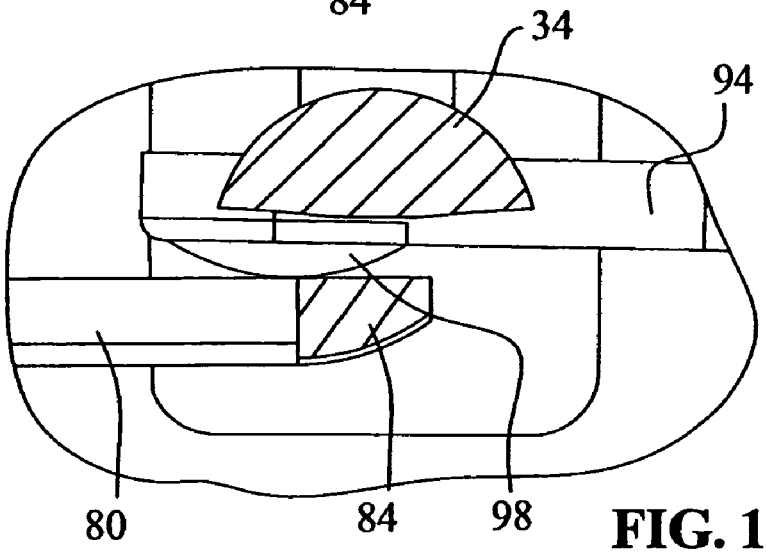
FIG. 14 shows the movement of the first and second contact portions into an intermediate position prior to their stop position.

It should also be noted that during the progression from FIGS. 13 to 15, reversely bent portion 80 pivots around spherical dimple 98 preventing the arms from engaging in a back-to-back parallel manner. This prevents spiking in the insertion force during the insertion of the contact pin. Also as the stop portions 30, 50 are provided on the side walls, the vertical positioning of the stop edges 36, 56 is more precisely defined. Having the overstress feature extend from the side walls prevents any problems with dimensional stack up, because the tolerances of the receptacle "box" shape/dimensions, and the various metal thicknesses are not at issue and therefore do not accumulate. Also as viewed in FIG. 8, the cantilevered beam portions 76, 98 extend from the upper wall portion 16 and can also move upon resilient movement of reversely bent portions 80, 94 further reducing the stresses in the contact assembly 70. Finally, and with reference again to FIG. 3, the contact receptacle 4 is defined with a clean body for insertion through a seal. As lips 102, 104 extend downwardly into the associated recesses, 38, 40, no sheared edge is positioned where it may cut a seal during the insertion of the contact through the seal.

Figure 16:
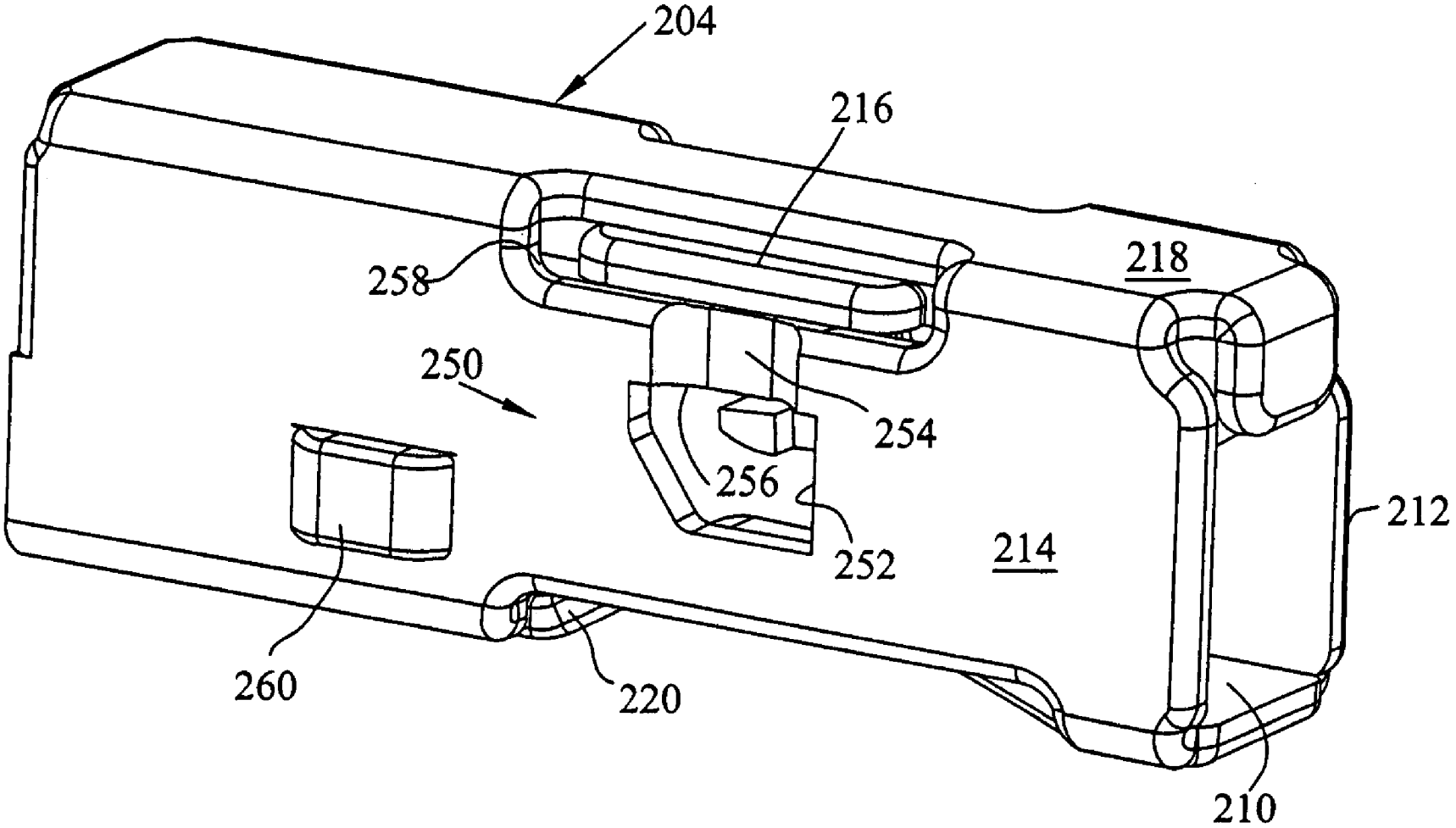
FIG. 16 shows a perspective view of the receptacle terminal portion of another embodiment of the terminal.

With reference now to FIGS. 16-19, an alternate embodiment of the terminal contact portion is shown. With reference first to FIG. 16, the receptacle contact portion is shown as 204 and includes a lower wall 210, sidewalls 212, 214, an upper wall 216 and a cover wall 218, which together form a body interior portion. With reference again to FIG. 16, lower wall 210 includes an inwardly directed contact portion at 220, which is substantially similar to inwardly directed contact portion 20.

With reference still to FIG. 16, sidewall 214 includes a contact stop-portion 250 including a cut-out portion at 252 and a strap portion at 254 extending above the cut-out portion 252 and inwardly directed to define a lower engagement edge at 256. Sidewall 214 further includes a recessed section at 258, to receive upper wall 216 and further includes an aligning lug such as 260 for aligning the terminal with a housing cavity.

Figure 17:
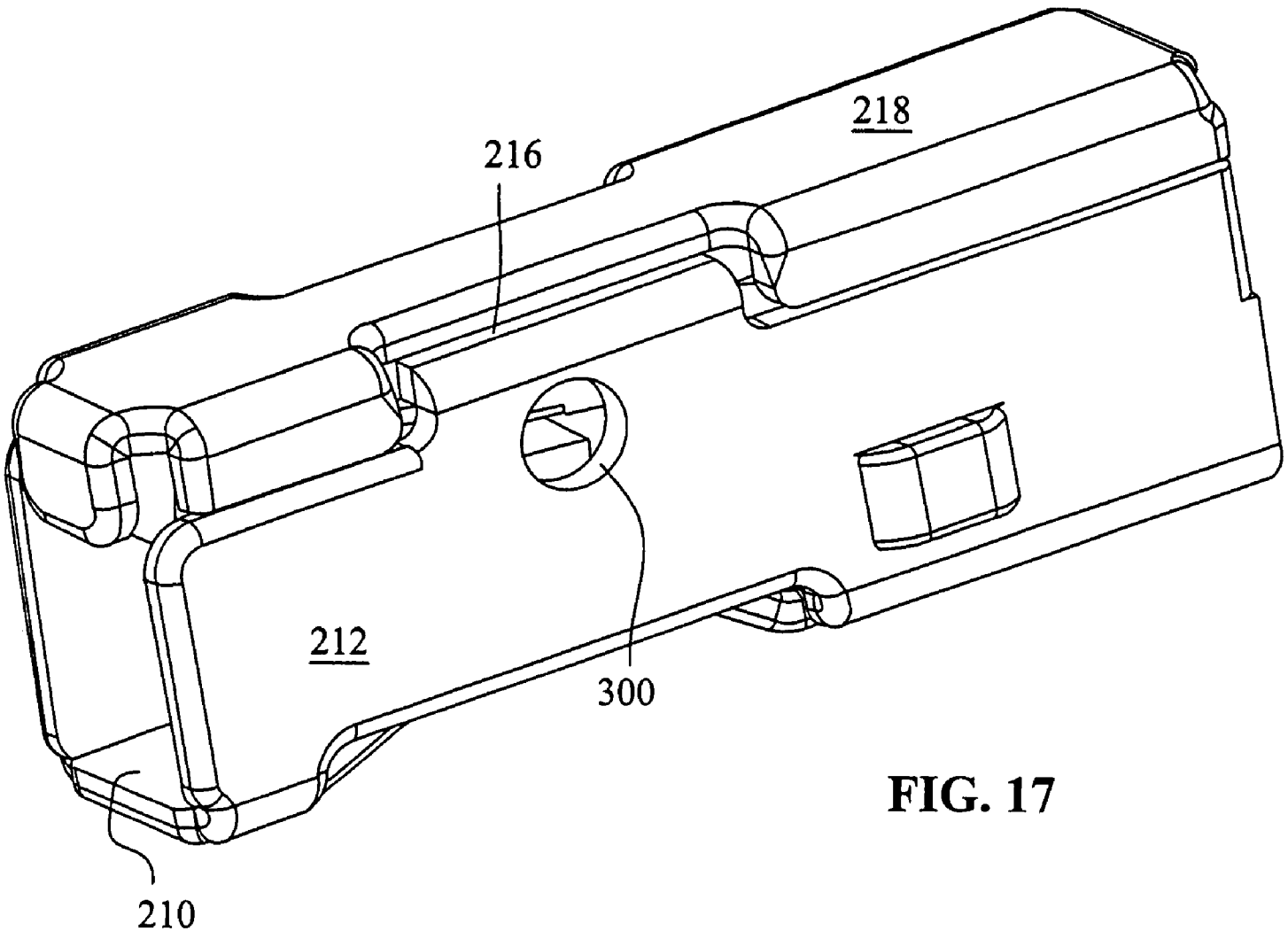
FIG. 17 shows a perspective view of the opposite side of the receptacle terminal portion of FIG. 16.
Figure 18:
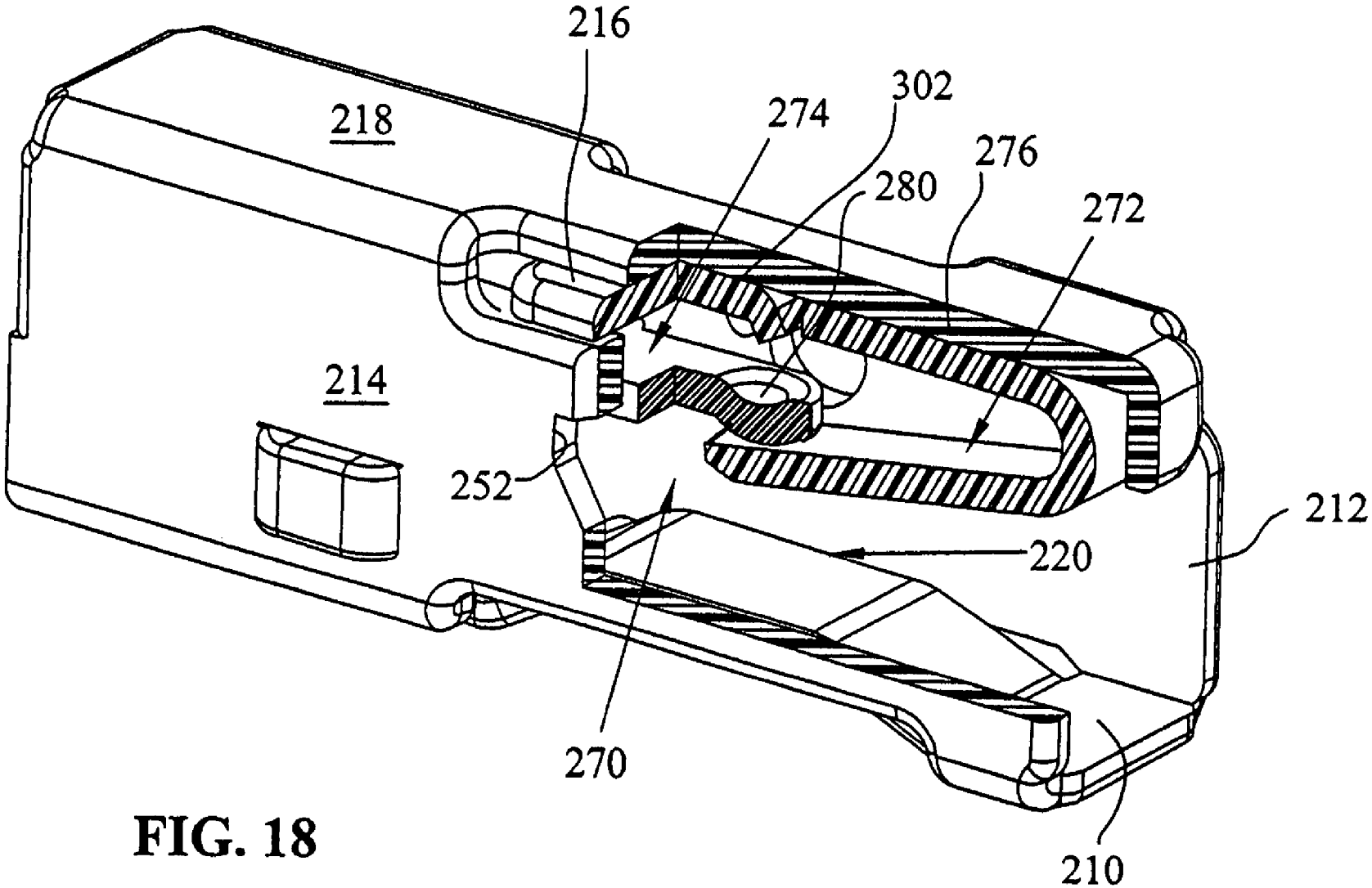
FIG. 18 shows the perspective view of FIG. 16, partially cut away.

With reference now to FIGS. 16-18, upper wall 216 is shown spanning between sidewalls 212 and 214 and integrally connected to sidewall 212. As shown in FIG. 16, upper wall 216 is shown received in recessed section 258 of sidewall 214. With reference now to FIG. 18, upper wall 216 is shown in section yet includes a contact assembly 270 extending integrally from upper wall 216 to include a first or primary contact portion 272 and a second or secondary contact portion 274. The contact portions 272 and 274 are substantially identical to contact portions 72, 74.

The free-end of reversely bent portion 274 is crowned, to define a spherically shaped dimple 280 (FIG. 18) positioned over contact portion 272, in the overlapping region of contact portions 272, 274.

As mentioned above, contact stop portion 250 is substantially similar to contact stop portion 50, however sidewall 212 does not have a contact stop portion analogous to stop portion 30. Rather, sidewall 212 only includes a visual opening 300 (FIG. 7) for observing the condition and/or locations of contact portions 272, 274. Rather than having a contact stop portion analogous to contact stop portion 30, tab portion 302 extends downwardly from upper wall 216 and extends downwardly towards contact portion 274. In this manner, stop portion 250 acts as a primary stop for primary contact portion 272, and tab portion 302 acts as a secondary contact stop for secondary contact portion 274.

What is claimed is:

1. An electrical terminal comprising:

a body portion comprising a lower wall, an upper wall, and side walls connecting the upper and lower walls, said upper and lower walls and said side walls forming a body interior portion;

a first contact portion extending from one of said walls and being reversely bent into the body interior portion;

a second contact portion extending from said one wall, and being reversely bent into the body interior portion, said first and second contact portions extending in opposite and overlapping relation;

an arcuate contact portion, positioned intermediate the first and second contact portions, and profiled to allow the first and second contact portions to pivot around the arcuate contact portion, upon deflection of the first and second contact portions; and at least one indentation extending into the body interior portion, and extending from a wall transverse to the one said wall, said indention providing a stop position for said first contact portion.

2. The electrical terminal of claim 1, wherein said first and second contact portions extend from said upper wall.

3. The electrical terminal of claim 1, wherein said first contact portion, in the location of said indentation, forms a T-shaped portion.

4. The electrical terminal of claim 1, comprising two indentations extending into the body interior portion, and extend from said sidewalls.

5. The electrical terminal of claim 1, wherein said one indentation extends from one of said side walls, and further comprising a tab portion extending inwardly from the upper wall to provide a contact overstress stop.

6. The electrical terminal of claim 1, wherein said indentation extends inwardly from one of said side walls.

7. The electrical terminal of claim 6, wherein said indentation is sheared along a lower edge and formed inwardly to define a downwardly extending cup-shaped portion, and wherein said sheared edge forms the stop position.

8. An electrical terminal, comprising:

a body portion comprising a lower wall, an upper wall, and side walls connecting the upper and lower walls, said upper and lower walls and said side walls forming a body interior portion;

a first contact portion extending from one of said walls and being reversely bent into the body interior portion;

a second contact portion extending from said one wall, and being reversely bent into the body interior portion, said first and second contact portions extending in opposite and overlapping relation; and said second contact portion including a crowned portion, extending towards, and in the overlapping portion with, said first contact portion, said first and second contact portions contacting each other through said crowned portion when a pin is inserted, wherein said crowned portion is arcuate, and profiled such that said first and second contact portion pivot about said arcuate portion, as said first and second contact portions are deflected.

9. The electrical terminal of claim 8, wherein said crowned portion is defined as a spherical dimple.

10. The electrical terminal of claim 8, wherein said first and second contact portions extending from said one wall in a cantilevered fashion, and said cantilevered portions on said first and second contact portions extend in the same plane as said one wall.

11. The electrical terminal of claim 8, wherein said first and second contact portions extend from said upper wall.

12. The electrical terminal of claim 11, wherein said lower wall includes a lower contact portion, formed inwardly in an axial position adjacent said first and second contacts.

13. An electrical terminal, comprising:

a body portion comprising a lower wall, an upper wall, and side walls connecting the upper and lower walls, said upper and lower walls and said side walls forming a body interior portion;

a first contact portion extending from one of said walls and being reversely bent into the body interior portion;

a second contact portion extending from one of said walls, and being reversely bent into the body interior portion, said first and second contact portions extending in opposite directions with a region of their distal ends in an overlapping relation; and one of said contact portions including a protuberance in the overlapping region, said protuberance projecting towards the other of said contacts, whereby, when a pin is inserted, said first and second contact portions contact each other through said protuberance, wherein the only contact between the first and second contact portions is through said protuberance and said protuberance is arcuate, and profiled such that said first and second contact portions pivot about said arcuate portion, as said first and second contact portions are deflected.

14. The electrical terminal of claim 13, wherein one of said first and second contact portions is positioned internally of the other, and forms an inner spring for the other, and the other of said first and second contact portions comprising a contact surface, said protuberance being defined on said inner spring projecting towards the other of said first and second contact portions.

* * * * *